US007189337B2

(12) United States Patent
Sortwell

(10) Patent No.: US 7,189,337 B2
(45) Date of Patent: Mar. 13, 2007

(54) METHODS FOR PREVENTING AND/OR EXTINGUISHING FIRES

(75) Inventor: Edwin T. Sortwell, St. Simons Island, GA (US)

(73) Assignee: Barricade International. Inc., Hobe Sound, FL (US)

( * ) Notice: Subject to any disclaimer, the term of this patent is extended or adjusted under 35 U.S.C. 154(b) by 289 days.

(21) Appl. No.: 10/843,739

(22) Filed: May 12, 2004

(65) Prior Publication Data

US 2005/0045849 A1 Mar. 3, 2005

Related U.S. Application Data

(60) Provisional application No. 60/469,709, filed on May 12, 2003.

(51) Int. Cl.
*A62D 1/00* (2006.01)

(52) U.S. Cl. ..... 252/8.05; 252/606; 252/604; 252/607; 252/610; 169/44

(58) Field of Classification Search ..... None
See application file for complete search history.

(56) References Cited

U.S. PATENT DOCUMENTS

| | | | | |
|---|---|---|---|---|
| 3,758,641 | A | 9/1973 | Zweigle | 260/874 |
| 4,510,081 | A * | 4/1985 | Bronner et al. | 252/603 |
| 4,725,370 | A | 2/1988 | Greene | 252/8.05 |
| 4,978,460 | A | 12/1990 | Von Blücher et al. | 252/2 |
| 5,190,110 | A | 3/1993 | Von Blücher et al. | 169/46 |
| 5,989,446 | A | 11/1999 | Hicks et al. | 252/8.05 |
| 6,245,252 | B1 | 6/2001 | Hicks et al. | 252/8.05 |

* cited by examiner

*Primary Examiner*—Matthew A. Thexton
(74) *Attorney, Agent, or Firm*—Marshall, Gerstein & Borun LLP

(57) ABSTRACT

In the prevention of the spread of fires and for directly fighting fires, a cross-linked, water-swellable additive polymer in a vegetable oil dispersion is added to firefighting water. The additive has the properties of absorbing large quantities of water, high viscosity for adherence to vertical and horizontal surfaces, and retention of sufficient fluidity to be educted in standard firefighting equipment. The method of adding this additive to the firefighting water by eduction, pumping, or batch addition to the source water is also disclosed.

39 Claims, 2 Drawing Sheets

METHODS FOR PREVENTING AND/OR EXTINGUISHING FIRES

CROSS-REFERENCE TO RELATED APPLICATION

The benefit under 35 U.S.C. §119(e) of U.S. provisional patent application Ser. No. 60/469,709, filed May 12, 2003, the disclosure of which is incorporated herein by reference, is claimed.

BACKGROUND OF THE DISCLOSURE

1. Field of the Disclosure

The disclosure relates generally to methods for preventing and/or extinguishing fires and, more specifically, to methods for applying water-laden polymer particles to a surface to prevent and/or extinguish fires.

2. Brief Description of Related Technology

Water is commonly used to extinguish fires and to prevent the spread thereof to nearby structures. Water has several beneficial effects when applied to a fire, including heat removal and oxygen deprivation. When water is directed at a structure adjacent a fire to prevent its spread thereto, the fire must provide enough heat to evaporate the water on (or in the materials of) the adjacent structure before the adjacent structure can reach its combustion or ignition temperature.

One disadvantage to using water to prevent a fire from spreading to a nearby structure is that most of the water directed at the structure does not soak into the structure to provide fire protection, but rather tends to run off the structure to the ground. Consequently, a significant quantity of water is wasted. Another disadvantage is that any water that does soak into the structure provides only limited protection against the fire because most structures only absorb a limited amount of water, and that limited amount of absorbed water quickly evaporates. Therefore, significant manpower must be expended to continuously reapply water on nearby structures to provide them with continuing fire protection.

A disadvantage to using water to extinguish fires is that a considerable amount of the water does not directly fight or extinguish the fire because of the run-off problem described above. Another disadvantage to using water in extinguishing fires is that the water sprayed directly on the fire evaporates at an upper level of the fire, with the result that significantly less water than is applied is able to penetrate sufficiently to extinguish the base of the fire.

To address the above disadvantages of using water (by itself) to fight fires, U.S. Pat. No. 5,190,110 to von Blücher et al. describes using an aqueous system comprising dry absorbent polymers to extinguish and/or prevent fires. The polymer particles have particle sizes from 20 microns to 500 microns, and are dispersed in water by stirring or pumping, such that the resultant viscosity does not exceed 100 centipoises (cps). This system contains discrete polymer particles that absorb water, without being soluble in water. Thus, the particles are entrained in the water, permitting their application directly to a fire. The dry, solid granular particles are typically pre-mixed with the water source. Alternatively, the dry, solid granular particles can also be added directly in advance of the nozzle. This alternative method does not provide sufficient time for the particles to swell and, consequently, the viscosity is not increased sufficiently to allow the particles to adhere to surfaces.

U.S. Pat. No. 4,978,460 to von Blücher et al. also describes using an aqueous system comprising dry absorbent polymers to extinguish and/or prevent fires. The dry, solid polymer particles of the '460 patent are encased by a water-soluble release agent to prevent agglutination of the particles. The time that it takes for the encapsulated solid granular particles to swell (i.e., expand from the absorption of water) ranges from ten seconds to several minutes. When fighting a fire with typical hose lengths, ten seconds is longer than practical for the water to be retained in a fire hose. Thus, when such encased polymer particles are used with standard fire-fighting equipment, there is not sufficient time for the particles to swell, and the viscosity is not increased sufficiently to allow the particles to adhere to surfaces.

U.S. Pat. No. 3,758,641 to Zweigle also describes using dry, solid, granular polymer particles with high water absorption in firefighting applications. Use of the disclosed particles is best accomplished with special, additional fire-fighting equipment.

Due to the dry, solid, granular nature of the aforementioned state-of-the-art firefighting, water-absorbent polymeric particles, it is difficult, if not impossible, to use such polymers in many firefighting applications. For example, eduction of such polymers into a standard firefighting hose with standard equipment is nearly impossible because of the particulate nature of such polymers. Moreover, the dry, solid nature of the polymers promotes agglutination of the particles and subsequent blockage of water flow from the firefighting hose. It is therefore sometimes necessary to provide special equipment such as "pumps and spray nozzles adapted for handling for such materials" to use the dry, solid granular particles in firefighting applications (see, for example, the '641 patent to Zweigle).

Additionally, if a natural source of water, such as a creek or a river, is to be used as the water source, it is impossible to pre-mix the polymer by batch adding it to the water source. For example, if one poured the polymer additive into a stream or river, most of the polymer additive will simply flow past the point of suction of the water for use in combating fires.

SUMMARY OF THE DISCLOSURE

The disclosure provides a vegetable oil dispersion containing a dry, ground, cross-linked, water-swellable polymer for use in preventing and/or extinguishing fires. Advantageously, the dispersion is easily mixed with a water supply. Moreover, the dispersion can be combined with water to provide a water-additive mixture with sufficiently high viscosity such that the mixture readily adheres to vertical and horizontal surfaces in functional thickness. Additionally, the polymer contained in the dispersion has a very short swell time (to absorb the water), and is easily educted into a fire hose through the use of standard firefighting equipment. Moreover, because the dispersion of the disclosure comprises vegetable oil, its use as an additive for fighting fires is environmentally favored relative to mineral oil emulsion-based polymers.

In one embodiment of the disclosure, the methods for applying polymer particles to a surface to prevent and/or extinguish a fire include providing cross-linked polymer particles in the form of a vegetable oil dispersion, adding the dispersion as a water-absorbent additive to water in an amount sufficient to increase the viscosity of the resulting water-additive mixture to above about 100 cps, and directing the additive/water mixture onto a surface to prevent and/or extinguish a fire, wherein after absorption of water the additive holds more than about 50 weight percent (wt. %) of the total water.

In another embodiment of the disclosure, the methods for applying polymer particles to a surface to prevent and/or extinguish a fire include adding a dispersion comprising a vegetable oil and a dry, ground, cross-linked, water-swellable polymer to water to form a water-additive mixture, and directing the water-additive mixture onto a surface to prevent and/or extinguish a fire, wherein the polymer holds more than about 50 weight percent (wt. %) of the water in the water-additive mixture after swelling.

DETAILED DESCRIPTION

Figure 1:
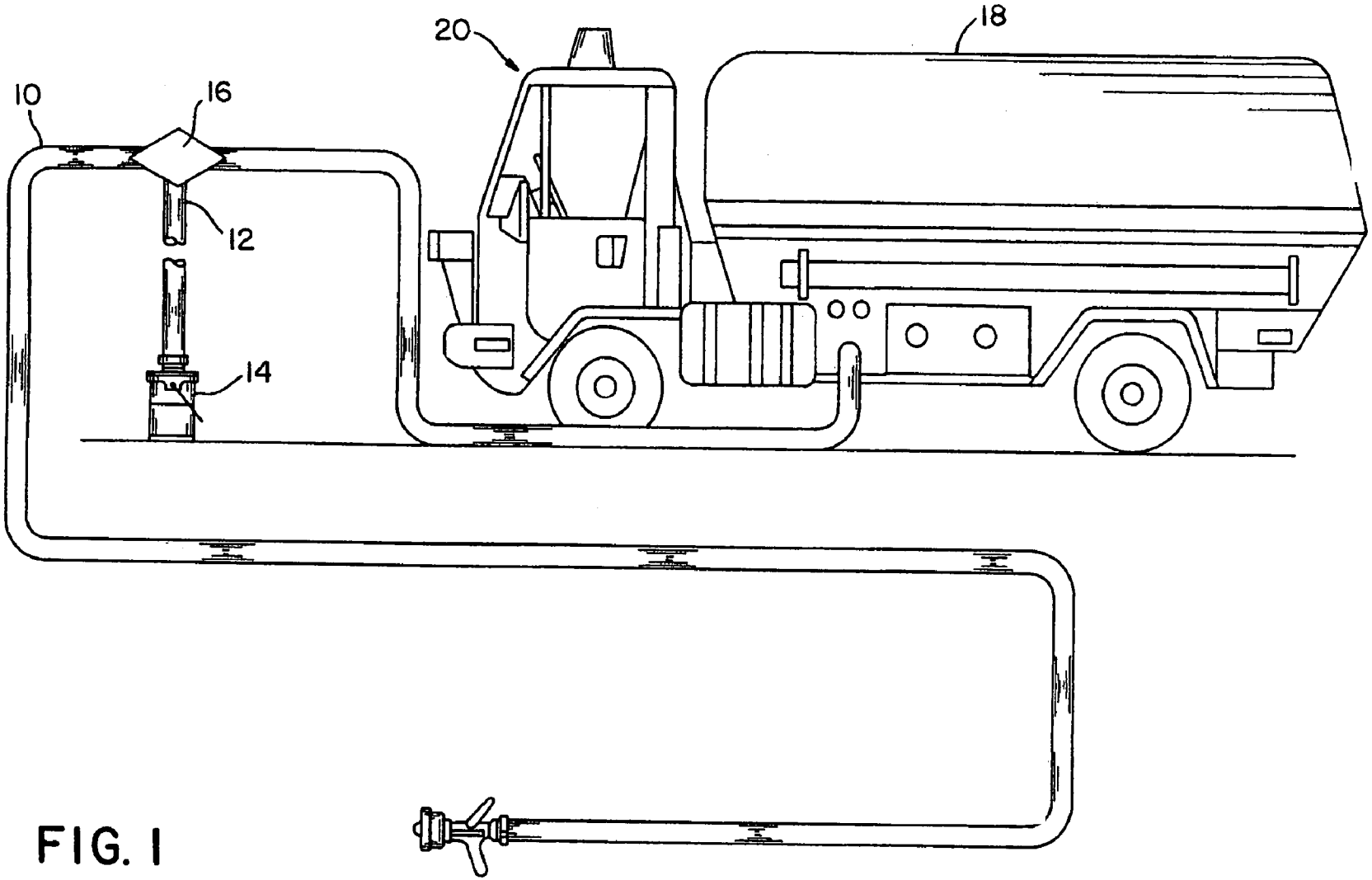
FIG. 1 is an illustration of typical equipment used to apply polymer particles to a surface to prevent and/or extinguish a fire; and, FIG. 2 is a schematic representation illustrating an embodiment of the disclosure.

The disclosed methods utilize a water additive to prevent and/or extinguish a fire. The additive is a dispersion containing a vegetable oil and a cross-linked, water-swellable polymer. The dispersion is produced by dispersing a ground, dry water-swellable polymer in vegetable oil, optionally with appropriate surfactant(s) and stabilizing agent(s), as needed or desired. In a preferred embodiment, the dispersion comprises a dry, cross-linked polymer in vegetable oil, and suitable emulsifier(s) and suspending agent(s).

Preferably, the dispersion is a dry, cross-linked polymer of at least one hydrophilic monomer dispersed in vegetable oil. Typically, the polymer is a copolymer of acrylamide and acrylic acid derivatives (e.g., an acrylate salt). Preferably, the polymer is a terpolymer of an acrylate salt, acrylamide, and 2-acrylamido-2-methylpropanesulfonic acid (AMPS) salt. The polymer particles resulting from the polymerization are generally ground to less than about 74 microns in size, usually with 70% of the particles being less than 37 microns in size. However, polymer particles having a size ranging from about 10 microns to about 200 microns may be used.

Virtually any water-insoluble vegetable oil may be used to prepare the dispersion. Preferably, the vegetable oil is rapeseed oil (or its refined form, canola oil).

A gel is typically formed after the dispersion is added to the fire-fighting water. The choice of the oil and the particle size of the dispersed cross-linked, water-swellable polymer particles is determined by the desired softness/stiffness of the gel that is formed after the dispersion is added to the fire-fighting water. Immobilized gel formation generally occurs in about three seconds or less; thus the particles preferably have a swell time of less than about three seconds. The gel typically has a viscosity of at least about 100 cps, preferably at least about 500 cps, up to about 50,000 cps. "Immobilized" gel formation means the gel will adhere to a vertical surface on contact.

Low HLB surfactants may be used to aid in the dispersion of the dry polymer particles in the vegetable oil. Higher HLB surfactants may be added to the dispersion to modify the flowability of the gel for specific fire-fighting requirements. A particularly suitable low HLB surfactant is sorbitan monooleate. Sorbitan monooleate is used as an emulsifier in foods.

Preferably, the additive is present in sufficient quantity such that after absorption of water, the additive holds more than about 50 wt. % of the total water.

A suspending agent, such as fumed silica, may be used to provide stability and flowability to the dispersion. This allows the dispersion to be introduced to the water supply in a liquid form, such that it can be easily educted with standard fire fighting equipment. The use of fumed silica not only provides stability to the dispersion, but also surprisingly increases the stability of the water-additive mixture (gel), and allows a lower additive concentration to produce an immobilized gel. Fumed silica is also approved as a direct food additive.

Polymeric dispersions that comprise, consist essentially of, or consist of vegetable oil (e.g., canola oil), sorbitan monooleate, and fumed silica are particularly desirable for health, safety, environmental and handling aspects in that these formulating components are either foods or are approved as direct food additives.

The additive is typically added to the water in a concentration of about 0.1 volume percent (vol. %) to about 50 vol. %, usually no more than about 20 vol. %. Preferably, the additive is added to the water in a concentration from about 0.1 vol. % to about 10 vol. %, more preferably from about 1 vol. % to about 3 vol. %, or from about 1 vol. % to about 2 vol. %.

The additive combines the properties of a super-absorbent polymer, in that it can absorb significant quantities of water in relation to its size and weight, and a thickener, in that the resulting water-additive mixture has a relatively high viscosity. Thus, the water-additive mixture that is sprayed from the end of a fire hose adheres readily in functional thickness to both vertical and horizontal surfaces. This adherence allows the water-additive mixture to prevent the fire from damaging the structure to which it adheres for a relatively long period of time, thereby minimizing the manpower needed to recoat the structure. Using this water-additive mixture to coat a structure that is near a fire therefore provides a protective coating to the structure. Thus, the fire will not spread as rapidly because it must overcome the effects of the significant quantity of water present in the water-laden polymer particles of the additive that adhere to the structure. Additionally, because the quantity of water absorbed by the additive evaporates less quickly than that provided by pure water, use of the additive provides more water to prevent and/or extinguish fires. Furthermore, the firefighting benefits of the additive can be replenished by misting (e.g., subsequent to coating a structure with the water-additive mixture). Misting is typically performed when a portion of the water held by the polymer evaporates.

The method of adding this additive to the firefighting water is preferably via eduction, pumping, or batch addition to the source water. The nature and properties of the additive enables eduction through standard firefighting equipment.

As shown in FIG. 1, the additive may be educted into a fire hose 10 in any suitable manner, such as that currently used to educt fire fighting foams, such as aqueous film-forming foam (AFFF). A trailing hose 12 is placed in a bucket 14 of additive. The flow of water through the fire hose 10 creates a negative pressure at an eductor nozzle 16, which then draws the additive from the bucket 14 into the flow of water through the fire hose 10. The eductor nozzle 16 has an internal valve by which the flow of additive may be controlled. This additive may be used with existing standard firefighting equipment and does not require purchase of new equipment. Because the additive is a flowable dispersion, there is no need to add a carrying or release agent to enable it to be educted or mixed.

Alternatively, the additive may be batch added to the water tank 18 on a fire truck 20. Once again, because the additive is a fluid dispersion, there is no need for extensive agitation or for addition of a separate carrying or release agent to avoid clumping, as is necessary with the solid additives that are presently used. Only limited mixing is typically required in such a batch addition of the additive of the disclosure.

When the additive is introduced to a significant quantity of fire fighting water such as through eduction into a fire hose or batch addition into a water tank, the dispersion mixes with the firefighting water, and the polymer particles within the dispersion are exposed to a large volume of water and quickly absorb significant quantities of the water.

The swollen particles from the vegetable oil dispersion form a homogeneous, highly viscous fluid. Because of the nature of the dispersion, the resulting water-additive mixture has a short (preferably about three seconds or less) swell or absorption time and relatively high viscosity, which allows the mixture to easily adhere to both vertical and horizontal surfaces. Moreover, the water-additive mixture has sufficient fluidity to allow the additive to be easily educted through standard fire fighting equipment.

Figure 2:
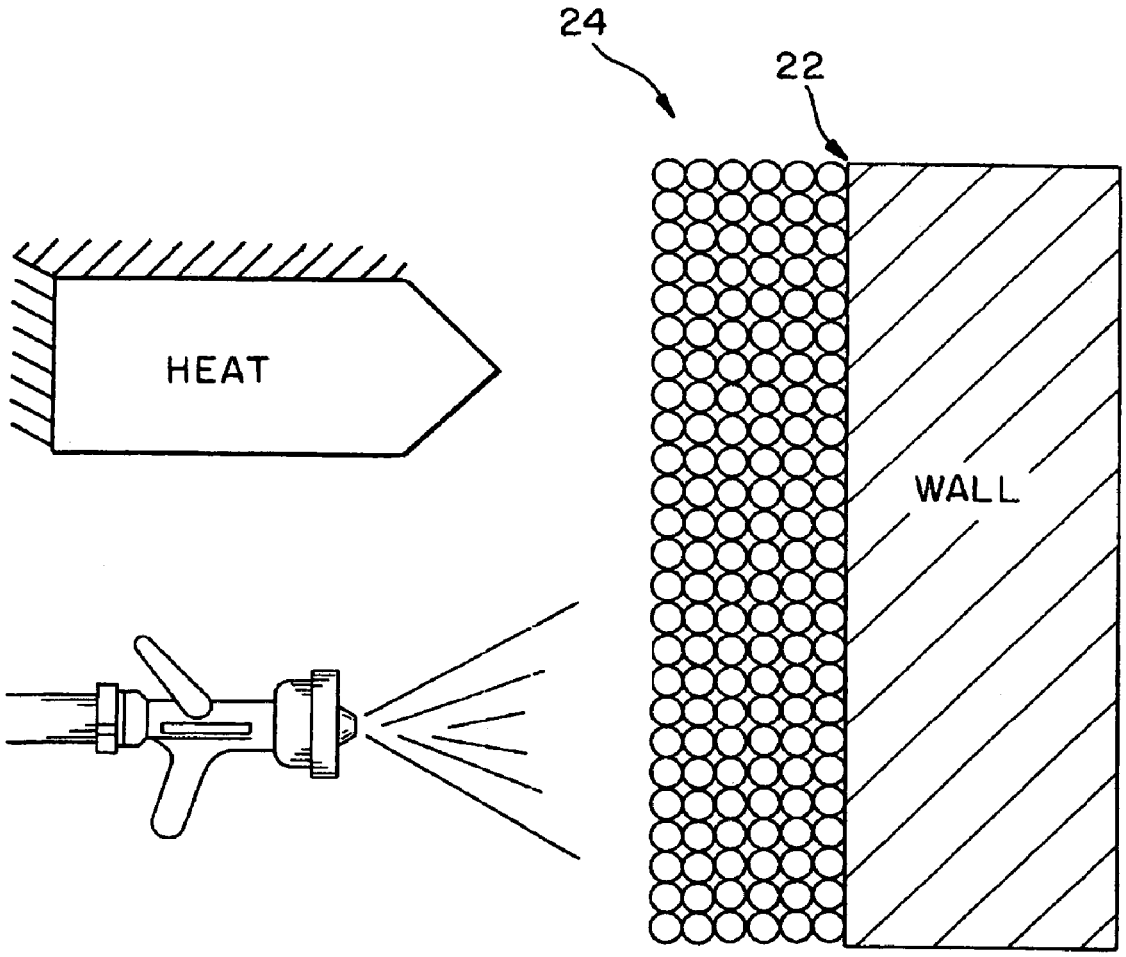

When the water-additive mixture is sprayed onto a vertical or horizontal surface, the mixture adheres to the surface, thereby extinguishing the fire and/or providing extended fire protection for structures located near a fire. As illustrated in FIG. 2, when the mixture is sprayed onto a surface 22, water-laden polymer particles 24 are stacked on top of each other. This is similar to how AFFF and other foams are used, but the polymer particles 24 are laden with water and the traditional foam bubbles are filled with air. This water fill dramatically enhances the thermal protection qualities of the additive.

When the fire approaches the surface 22, the outer water-laden polymer particles 24 that are closest to the fire absorb the heat until the point of water evaporation is reached. Thus, the water-laden polymer particles 24 that are closer to the wall are protected until the water of the outer water-laden polymer particles 24 evaporates. Then the next layer of water-laden polymer particles 24 absorbs heat until the point of water evaporation is reached, thereby shielding the remaining inner layers of water-laden polymer particles. This process continues until the water of the innermost layer of water-laden polymer particles 24 is evaporated. This process absorbs heat significantly more effectively than does the use of conventional foams that use air instead of water to absorb the heat as water has a significantly higher heat capacity than air bubbles.

As an additional benefit, by the time that the fire has evaporated the water from the water-laden polymer particles layers down to the protected surface, the coating on the surface above the point of fire penetration may slide down to partially re-coat and continue to protect the area penetrated by the fire, depending on the viscosity of the coating gel. This also minimizes the manpower and material resources currently necessary to periodically re-soak the surface. Obviously, at some point the fire will evaporate substantially all of the water from the additive if the fire continues to burn. But by retarding the advance of the fire and the damage done by the fire, and by using the additive to directly fight the fire, firefighters will be able to more effectively fight the slowed fire and the damage done by the fire will be significantly reduced relative to the damage done when conventional firefighting techniques and materials are used to fight fires. Accordingly, the additive represents a substantial leap forward in firefighting technology.

As previously described, when water is sprayed directly onto a fire, much of the water never effectively fights the fire because the superheated air above the fire evaporates the water before the water can reach the flames. However, when the disclosed additive is used, more water reaches the fire because the water-laden additive polymer particles retard evaporation, the evaporation process is slower. Thus, not only does more water reach the fire, less water is used than when using simply water, or even when using conventional additives, such as fire fighting foams. Also, when simply applying water, a larger proportion of the water that is applied directly to the fire (and is not evaporated) runs off or soaks into the ground and is thus wasted after its initial application. As an additional benefit, the water-additive mixture of the disclosure also coats the ashes or the charred structure that was burning, instead of running off or soaking into the ground, and helps to prevent re-flashing, because the water-laden polymer particles are able to absorb heat and the mixture, which is viscous, adheres to the surface and deprives the surface of the oxygen needed for combustion, thus also providing a smothering effect on the burned surface.

Because of these properties of the additive, the water-additive mixture is also suitable for use as an artificial fire break when fighting forest or brush fires. The mixture can be sprayed in advance of the fire and will coat the structure, such as bushes and trees, such that the fire will stop its advance when it reaches the treated area, allowing the firefighters to extinguish the flames without the fire advancing further. This causes significantly less damage than does the use of conventional means of fire breaks, such as using bulldozers or controlled burning to clear an area for a fire break.

The additive can absorb water in significant quantities relative to its own weight. Once the additive particles have been added to the firefighting water and absorb water to their capacity (preferably in three seconds or less), the particles can carry more than about 90 wt. % of the water that is used to fight the fire.

The polymer is preferably a dry, cross-linked, water-swellable polymer in a vegetable oil dispersion. The polymer may be a polymer of hydrophilic monomers, such as acrylamide, acrylic acid derivatives, maleic acid anhydride, itaconic acid, 2-hydroxyl ethyl acrylate, polyethylene glycol dimethacrylate, allyl methacrylate, tetraethyleneglycol dimethacrylate, triethyleneglycol dimethacrylate, diethylene glycol dimethacrylate, glycerol dimethacrylate, hydroxypropyl methacrylate, 2-hydroxyethyl methacrylate, 2-tert-butyl amino ethyl methacrylate; dimethylaminopropyl methacrylamide, 2-dimethylaminoethyl methacrylate, hydroxypropyl acrylate, trimethylolpropane trimethacrylate, 2-acrylamido-2 methylpropanesulfonic acid derivatives, and other hydrophilic monomers. Preferably, the polymer is a copolymer of acrylamide and acrylic acid derivatives and, more preferably, a terpolymer of an acrylate salt, acrylamide, and a 2-acrylamido-2-methylpropanesulfonic acid (AMPS) salt. The salts may generally be any monovalent salt, but preferably are sodium or potassium salts.

Many such dry polymers are commercially available and are routinely used in diapers. A viscosity of significantly greater than 100 cps and even in the range from 500 cps to 50,000 cps is easily obtainable and beneficially utilized for the disclosed additive. This is in contrast with the state of the art as represented by U.S. Pat. No. 5,190,110 to von Blücher et al., which teaches that viscosities above 100 cps are undesirable and unworkable in fighting fires. The higher viscosities of the water-additive mixture allow the water-additive mixture to have better adherence to vertical surfaces, yet the water-additive mixtures are still sufficiently fluid such that the additive can be successfully educted through standard firefighting equipment.

Because the degree of hardness of the water, in other words the amount of divalent cations in the water, affects the degree of swelling of the polymer particles, a component may also be introduced to counteract water hardness. A suitable monomer to counteract water hardness in this application is AMPS or a derivative thereof. The amount of AMPS included in the dry polymer may be varied depending on the hardness of the water in the particular region of use. Nevertheless, the polymer is effective without inclusion of a chemical to counteract water hardness, particularly in geographical regions that do not have hard water.

The polymer particle size in the dispersion is generally less than 74 microns with 70% to 95% of the particles generally less than about 37 microns in size. The particle size of the polymer allows for a preferred swell time of about three seconds or less so that the particles complete their swelling during the time from when the additive is educted into the fire water to when the additive/water mixture is to be immobilized on the surface to be protected. Due to their dispersion in a vegetable oil/surfactant system, the particles in the additive of the disclosure will preferably have a swell time of about three seconds or less, whereas the swell time of conventional polymer particles have, at best, a swell time of about 10 seconds (see, e.g., the '460 to von Blücher et al.). Conventional polymer particles often have swell times of minutes or even hours (see, e.g., U.S. Pat. No. 3,247,171 to Walker et al.) before absorbing sufficient water to be suitable for use in fighting fires. These longer swell times are inadequate for use in an eduction system without significant advance preparation and/or special equipment.

Because of the short swell time and the fluid state of the disclosed additive, the additive is superbly situated to be used in a standard eduction system with a fire hose and a water source, such as a tanker truck or a fire hydrant. This eliminates the need for special equipment to practice the methods of the disclosure. The disclosure is also suitable for use by directly adding the additive to a tank of a tanker truck. To this end, only 10 gallons to 15 gallons of additive (i.e., less than 130 lb.) are necessary to treat the standard 500 gallon tank on a fire tanker truck. This is a significant improvement over the state of the art, as illustrated by the '460 patent to von Blücher et al., wherein 200 grams of additive are required for every liter of water, which is equivalent to about 835 pounds for a typical 500 gallon tank.

EXAMPLES

Several tests of the additive have been conducted to evaluate the firefighting and fire protection properties thereof.

Example 1

A 4 feet by 4 feet sheet of ¼ inch thick plywood was coated with Product 4 of the table, below, using an eductor, to a thickness of approximately ¼ inch with a 2.5 vol. % solution of a water-additive mixture. Following this application, the plywood was subjected to an open flame generated by a propane gas jet. The time to burn through the treated plywood was measured and compared with the time to burn through an identical sheet of plywood that was not treated. The burn-through time for the treated plywood was 9 minutes, 12 seconds. The burn-through time for the untreated plywood was 2 minutes, 40 seconds.

Examples 2–7

Comparative Fire Protection

Eduction of additive into a fire water stream does not guarantee exact concentration of the additive nor permit exact gel coating thickness. In order to make exact fire retardant comparisons of additive concentrations, gel thicknesses and vertical surface stabilities, experiments were performed to control these variables. Exact concentrations of a series of additives were prepared in a blender at a low speed that simulated eductor preparation. ¼ inch thick poplar boards were coated with exact coating thicknesses (using a draw-down technique). Additionally, an exact propane flame heat and impingement distance were used. In all cases, gels prepared in the blender from the additive/water mixture and used in the tests, were immobilized in less than three seconds. The gel was then spread on the poplar board to the thickness detailed in the table 1, and tested as described above.

| Product | Type | Product Concentration (Vol. %) Necessary to Produce Vertically Stable, Immobile Gel Coating | Coating Thickness (inches) | Time to Burn Through Gel Coating | Total Time to Burn Through ¼" Board (min:seconds) |
|---|---|---|---|---|---|
| No coating (control) | — | — | — | (1) | 2:24 |
| (2) | Mineral Oil-Based Emulsion | 3.5% | ¼" | 2:45 | 5:28 |
| (2A) | Mineral Oil-Based Emulsion + 2% Fumed Silica | 3.5% | ¼" | 3:06 | 5:40 |
| (3) | Dry | 4.0% | ¼" | 2:40 | 5:10 |
| (4) | Polymer | 3.5% | ¼" | 4:11 | 7:00 |
| (4) | Based | 3.0% | ¼" | 4:04 | 6:40 |
| (4) | Dispersions | 2.5% | ¼" | 2:46 | 5:48 |
| (4) | | 3.0% | ⅛" | 2:05 | 4:50 |
| (5) | | 3.5% | ¼" | 3:41 | 6:38 |

-continued

| Product | Type | Product Concentration (Vol. %) Necessary to Produce Vertically Stable, Immobile Gel Coating | Coating Thickness (inches) | Time to Burn Through Gel Coating | Total Time to Burn Through ¼" Board (min:seconds) |
|---|---|---|---|---|---|
| (6) | | 3.0% | ¼" | 3:50 | 5:46 |
| (7) | | 2.0% | ¼" | 2:30 | 5:30 |

Reference Notes:

(1) Surface of Control board burst into flame in 11 seconds and burned through in 2 minutes, 24 seconds.

(2) Mineral oil-based commercial emulsion fire-fighting product, 38 weight percent (wt. %) active polymer content.

(2A) (2) plus 2 wt. % fumed silica (CAB-O-SIL EH-5) added.

(3) Dry polymer-based dispersion: 38.9 wt. % ground dry polymer (dry polymer 99.9% less than 74 microns, 94.5% less than 44 microns, 90% less than 37 microns), 2.4 wt. % sorbitan monooleate (Span 80), 58.7 wt. % canola oil.

(4) Dry polymer-based dispersion: 38.2 wt. % ground dry polymer (same grind of dry polymer as in (3), above), 2.3 wt. % sorbitan monooleate 1.7 wt. % fumed silica (CAB-O-SIL EH-5), 57.8 wt. % canola oil.

(5) Dry polymer-based dispersion: 38.0 wt. % ground dry polymer (same grind of dry polymer as in (3) and (4), above), 2.3 wt. % sorbitan monooleate (Span 80), 0.6 wt. % high HLB surfactant (Dow XL-80N), 1.7 wt. % fumed silica (CAB-O-SIL EH-5), 57.4 wt. % canola oil.

(6) Dry polymer-based dispersion: 38.2 wt. % ground dry polymer (dry polymer 99.8% less than 74 microns, 82.9% less than 44 microns, 73.4% less than 37 microns), 2.3 wt. % sorbitan monooleate (Span 80), 1.7 wt. % fumed silica (CAB-O-SIL EH-5), 57.8 wt. % canola oil.

(7) Dry polymer-based dispersion of the disclosure: 39.1 wt. % ground dry polymer (same grind as in (3), (4) and (5), above), 1.8 wt. % fumed silica (CAB-O-SIL EH-5), 59.1 wt. % canola oil.

The data in the table demonstrate the surprising performance of firefighting gel produced from the disclosed dry polymer-containing product. Product 4, a fine-ground dry polymer in canola oil incorporating low HLB emulsifier and fumed silica, gives superior fire protection to Product 3, the same formulation but without fumed silica. Besides providing stability to the dispersion, the presence of fumed silica surprisingly stabilizes the gel formed when the dispersion is added to the fire-fighting water, significantly reducing the concentration needed for the gel coating to adhere to the vertical surface. This not only means a lower concentration of dispersion is required to produce a vertically stable gel, but also that the water available in the gel to fight the fire is increased for a given gel thickness.

For comparison, a commercial mineral oil-based emulsion product (Product 2) was tested. Product 2 is inferior in fire protection to Product 4 of the disclosure. Further, the viscosity of Product 2's mineral oil-based formulation is not significantly improved (in Product 2A) by the addition of filmed silica to allow for reduced concentration. The increased gel stability confered by the fumed silica with the vegetable oil (which is in reality a naturally occurring fatty acid ester) carrier in the dispersion of disclosure is a significant and unexpected benefit.

As described in U.S. Pat. No. 6,245,252 B1 (col. 7, line 19) emulsion polymers produced by inverse phase polymerization require higher HLB emulsifiers in order to quickly "invert" the emulsion. The inverting emulsifier emulsifies the oil-continuous-phase into the diluting water, exposing the polymer particles to the water so they can swell. In the present disclosure, which uses a vegetable oil, i.e., a fatty acid ester, an inverting surfactant, which is often referred to as a wetting agent, is not required in order to quickly produce a very stable gel.

Another surprising result is that the addition of wetting agent (high HLB surfactant) in Product 5 does not measurably reduce the time for gel formation (all tested products formed gel in less than about 3 seconds). Further, the addition of the high HLB surfactant reduces the viscosity of the gel to the extent that the concentration cannot be reduced to the extent possible with Product 4, the high HLB-free product, and still maintain a stable vertical coating. The combination of the dry, ground polymer in a vegetable oil containing low HLB surfactant and fumed silica with water produces a smooth, homogenous gel that is an extremely effective fire-fighting product. Without the low HLB surfactant (Product 7), a 2 vol. % concentration will produce a vertically stable gel but the coating is not as homogenous and concentrations above 2.5 vol. % become friable. Application control would be difficult with eductor nozzles.

Product 6 demonstrates that an even courser grind of the dry polymer may be used, however some vertical gel stability is lost, requiring a slightly higher gel concentration when compared to Product 4.

In application, the additive may be provided in a one gallon or five gallon container for use with a standard eduction system. The concentration of additive for the eduction is preferably between 0.1% and 10% (volume to volume), but concentrations of up to 20 vol. % are acceptable. Once the concentration is significantly above 20 vol. %, the viscosity of the water-additive mixture often becomes unwieldy. Likewise, for use in direct mixing into a tank, the additive is batch mixed in a concentration of preferably between 0.1 vol. % and 10 vol. %, but concentrations of up to about 20 vol. % are acceptable. Additive concentrations of from about 1.0 vol. % to about 3.0 vol. % provide suitable characteristics for firefighting, and greater concentrations are generally unnecessary. The use of lower concentrations also improves cost effectiveness.

What is claimed is:

1. A method for applying water-laden polymer particles to a surface to prevent and/or extinguish a fire, the method comprising:

(a) adding a dispersion comprising a vegetable oil and a dry, ground, cross-linked, water-swellable polymer to water to form a water-additive mixture containing water-laden polymer particles, wherein the polymer holds more than about 50 weight percent (wt. %) of the water in the water-additive mixture after swelling, the oil and the particle size of the polymer being selected to result in the formation of an immobilized gel; and, (b) directing the water-additive mixture comprising the immobilized gel onto a surface to prevent and/or extinguish a fire.

2. The method of claim 1, wherein the dispersion further comprises at least one additive selected from the group consisting of surfactants and stabilizing agents.

3. The method of claim 1, wherein the dispersion is added in an amount sufficient to increase the viscosity of the water-additive mixture to above 100 centipoises (cps).

4. The method according to claim 1, wherein the vegetable oil is selected from the group consisting of rape seed oil and canola oil.

5. The method according to claim 2, wherein the surfactant has a net hydrophobic/lipophilic balance (HLB) value less than about 8.

6. The method according to claim 2, wherein the stabilizing agent is fumed silica.

7. The method of claim 1, wherein the adding comprises educting the dispersion into the water with standard firefighting eduction equipment.

8. The method of claim 1, wherein the adding comprises batch-adding the dispersion to the water.

9. The method of claim 1, wherein the polymer has a swell time of less than about three seconds.

10. The method of claim 1, wherein the dispersion is added in an amount sufficient to increase the viscosity of the water-additive mixture to between about 500 cps and about 50,000 cps.

11. The method of claim 1, wherein the polymer is formed from a hydrophilic monomer.

12. The method of claim 11, wherein the hydrophilic monomer is selected from the group consisting of acrylamides and acrylic acid derivatives.

13. The method of claim 12, wherein the acrylic acid derivative is an acrylate salt.

14. The method of claim 1, wherein the polymer is a terpolymer of an acrylate salt, acrylamide, and a 2-acrylamido-2-methylpropanesulfonic acid salt.

15. The method of claim 1, wherein a concentration of the dispersion of the water-additive mixture is between about 0.01 percent by volume (vol. %) and about 50 vol. %.

16. The method of claim 1, wherein a concentration of the dispersion of the water-additive mixture is between about 0.1 vol. % and about 10 vol. %.

17. The method of claim 1, wherein a concentration of the dispersion of the water-additive mixture is between about 1 vol. % and about 2 vol. %.

18. A method for applying water-laden polymer particles to a surface to prevent and/or extinguish a fire, the method comprising:

(a) adding a dispersion comprising a vegetable oil and a dry, ground, cross-linked, water-swellable polymer to water to form a water-additive mixture containing water-laden polymer particles, wherein the dry polymer has a particle size of from about 10 to about 200 microns, and wherein the polymer holds more than about 50 weight percent (wt. %) of the water in the water-additive mixture after swelling, the oil and the particle size of the polymer being selected to result in the formation of an immobilized gel; and, (b) directing the water-additive mixture comprising the immobilized gel onto a surface to prevent and/or extinguish a fire.

19. The method of claim 18, wherein the dry polymer comprises particles having a particle size of less than 74 microns.

20. The method of claim 18, wherein the dry polymer comprises particles having a particle size of less than 44 microns.

21. The method of claim 18, wherein the dry polymer comprises particles having a particle size of less than 37 microns.

22. The method of claim 19, wherein 70% to 95% of the particles of the dry polymer have a particle size of less than 37 microns.

23. The method of claim 19, wherein 90% of the particles of the dry polymer have a particle size of less than 37 microns.

24. The method of claim 18, wherein the dispersion further comprises at least one additive selected from the group consisting of surfactants and stabilizing agents.

25. The method of claim 18, wherein the dispersion is added in an amount sufficient to increase the viscosity of the water-additive mixture to above 100 centipoises (cps).

26. The method according to claim 18, wherein the vegetable oil is selected from the group consisting of rape seed oil and canola oil.

27. The method according to claim 24, wherein the surfactant has a net hydrophobic/lipophilic balance (HLB) value less than about 8.

28. The method according to claim 24, wherein the stabilizing agent is fumed silica.

29. The method of claim 18, wherein the adding comprises educting the dispersion into the water with standard firefighting eduction equipment.

30. The method of claim 18, wherein the adding comprises batch-adding the dispersion to the water.

31. The method of claim 18, wherein the polymer has a swell time of less than about three seconds.

32. The method of claim 18, wherein the dispersion is added in an amount sufficient to increase the viscosity of the water-additive mixture to between about 500 cps and about 50,000 cps.

33. The method of claim 18, wherein the polymer is formed from a hydrophilic monomer.

34. The method of claim 33, wherein the hydrophilic monomer is selected from the group consisting of acrylamides and acrylic acid derivatives.

35. The method of claim 34, wherein the acrylic acid derivative is an acrylate salt.

36. The method of claim 18, wherein the polymer is a terpolymer of an acrylate salt, acrylamide, and a 2-acrylamido-2-methylpropanesulfonic acid salt.

37. The method of claim 18, wherein a concentration of the dispersion of the water-additive mixture is between about 0.01 percent by volume (vol. %) and about 50 vol. %.

38. The method of claim 18, wherein a concentration of the dispersion of the water-additive mixture is between about 0.1 vol. % and about 10 vol. %.

39. The method of claim 18, wherein a concentration of the dispersion of the water-additive mixture is between about 1 vol. % and about 2 vol. %.

* * * * *

UNITED STATES PATENT AND TRADEMARK OFFICE

CERTIFICATE OF CORRECTION

PATENT NO. : 7,189,337 B2
APPLICATION NO. : 10/843739
DATED : March 13, 2007
INVENTOR(S) : Edwin T. Sortwell It is certified that error appears in the above-identified patent and that said Letters Patent is hereby corrected as shown below:

Col. 11, claim 5, line 17, delete “hydrophobic” and insert -- hydrophilic --

Col. 12, claim 27, line 28, delete “hydrophobic” and insert -- hydrophilic --

Signed and Sealed this

Twenty-third Day of December, 2008

JON W. DUDAS
*Director of the United States Patent and Trademark Office*